US006739603B1

(12) United States Patent
Powell

(10) Patent No.: US 6,739,603 B1
(45) Date of Patent: May 25, 2004

(54) TRUCK FOR SKATEBOARD OR ROLLER SKATE

(76) Inventor: George Powell, 8379 Vereda Del Padre, Goleta, CA (US) 93117

( * ) Notice: Subject to any disclaimer, the term of this patent is extended or adjusted under 35 U.S.C. 154(b) by 0 days.

(21) Appl. No.: 09/394,231

(22) Filed: Sep. 13, 1999

(51) Int. Cl.[7] ..... A63C 17/00

(52) U.S. Cl. ..... 280/11.27; 280/87.042; 280/11.28

(58) Field of Search ..... 280/11.27, 11.28, 280/7.13, 841, 600, 87.042, 87.041; 180/68.4, 300; 251/306; 384/220, 222, 275, 296

(56) References Cited

U.S. PATENT DOCUMENTS 2,341,576 A * 2/1944 Shye ..... 280/11.27
3,039,831 A * 6/1962 Thomas ..... 384/220
3,801,209 A * 4/1974 Matsuoka ..... 384/220
3,851,722 A * 12/1974 Crosseau ..... 180/68.4
4,194,752 A * 3/1980 Tilch et al. ..... 280/11.28
4,245,848 A * 1/1981 Dudouyt ..... 280/11.28
4,251,087 A * 2/1981 Hansen ..... 280/11.28
4,398,734 A * 8/1983 Barnard ..... 280/11.28
4,519,467 A * 5/1985 Saunders ..... 180/68.4
4,579,184 A * 4/1986 Hiramoto ..... 180/68.4
4,809,960 A * 3/1989 Kakimoto et al. ..... 384/222
4,817,974 A * 4/1989 Bergeron ..... 280/87.042
4,886,298 A * 12/1989 Shols ..... 280/87.042
4,896,893 A * 1/1990 Shumays et al. ..... 280/87.042
5,183,277 A * 2/1993 Tang ..... 280/11.28
5,544,714 A * 8/1996 May et al. ..... 180/68.4
5,853,182 A * 12/1998 Finkle ..... 280/11.27
5,879,013 A * 3/1999 Shih ..... 280/11.28
5,961,219 A * 10/1999 Maughan ..... 384/220
5,975,546 A * 11/1999 Strand ..... 280/87.042
6,022,000 A * 2/2000 Laulhe et al. ..... 251/306
6,105,984 A * 8/2000 Schmitz et al. ..... 280/124.136
6,129,766 A * 10/2000 Johnson et al. ..... 623/49

* cited by examiner

*Primary Examiner*—Brian L. Johnson
*Assistant Examiner*—Hau Phan
(74) *Attorney, Agent, or Firm*—Denton L. Anderson; Sheldon & Mak

(57) ABSTRACT

An improved truck for use with a skateboard or roller skate. The truck has a truck hanger attached to a mounting bracket. The truck hanger has opposed axle elements for mounting a pair of opposed wheels. The truck hanger also has a hanger flange and a hanger pivot. The mounting bracket has a base plate, a pivot bore and a king pin. The truck hanger is affixed to the mounting bracket with the hanger pivot disposed within the pivot bore and with the hanger flange disposed over the king pin. A hanger flange is sandwiched between an inner cushion element and an outer cushion element. Both the inner cushion element and the outer cushion element have an elastomeric outer portion and a substantially rigid liner portion.

20 Claims, 2 Drawing Sheets

TRUCK FOR SKATEBOARD OR ROLLER SKATE

FIELD OF THE INVENTION

This invention relates generally to trucks and, more specifically, to trucks useful on skateboards or roller skates.

BACKGROUND OF THE INVENTION

Trucks are important elements in the design of modern skateboards and roller skates (collectively "skates"). Trucks not only support the wheels of the skateboard or roller skates, they provide the user with a significant degree of directional control.

In a typical skate truck, directional control is accomplished by providing the truck with two primary components, a truck hanger and a mounting bracket. The truck hanger has opposed axle elements for carrying a pair of opposed skate wheels and is attached to the mounting bracket using a pair of in-line mounting pins, a hanger pivot and a king pin. The hanger pivot protrudes upwardly from the truck hanger and the king pin protrudes downwardly from the mounting bracket. The two primary elements of the truck are assembled with the hanger pivot disposed within a pivot bore defined within the mounting bracket, and with the king pin disposed within a hanger flange attached to the truck hanger. The hanger pivot is not rigidly retained within the pivot bore, so that the hanger pivot has some degree of play within the hanger bore. The hanger flange is retained on the king pin by a king pin nut. The hanger flange is retained on the king pin between a pair of elastomeric cushion elements. By this assembly, the hanger flange retains some side-to-side play when the user of the skateboard or roller skate leans to one side or the other. Such side-to-side play tends to cause the wheels to turn slightly to one side or the other. Thus, the user can control the forward direction of the skate by shifting his or her body from one side of the skate to the other.

Unfortunately, there is a problem with such trucks of the prior art. The elastomeric cushion elements which sandwich the hanger flange to the king pin tend to wear out quickly. Also, excessive side-to-side stress on the truck can dislocate or even damage the cushion elements.

Accordingly, there is a need for a simple and inexpensive skateboard/roller skate truck which avoids these problems with the prior art.

SUMMARY

The invention satisfies this need. The invention comprises a truck hanger having opposed axle elements, a wheel mounted on each axle element, a hanger flange and a hanger pivot, and a mounting bracket for attachment of the truck hanger to a skateboard or roller skate. The mounting bracket comprises a base plate, a pivot bore, a king pin protruding downwardly from the mounting bracket, an inner cushion element disposed around the proximal end of the king pin and an outer cushion element disposed around the distal end of the king pin. The truck hanger is affixed to the mounting bracket with the hanger pivot disposed within the pivot bore and with the hanger flange disposed over the king pin between the inner cushion element and the outer cushion element. In the invention, both the inner cushion element and the outer cushion element comprise an elastomeric outer portion and a substantially rigid liner portion bonded to the elastomeric portion.

The rigid liner portion of both cushion elements preferably has a tubular moiety and a flange moiety. The liners impart to the cushion element increased rigidity and stability.

DRAWINGS

These features, aspects and advantages of the present invention will become better understood with regard to the following description, appended claims and accompanying figures where:

DETAILED DESCRIPTION

Figure 1:
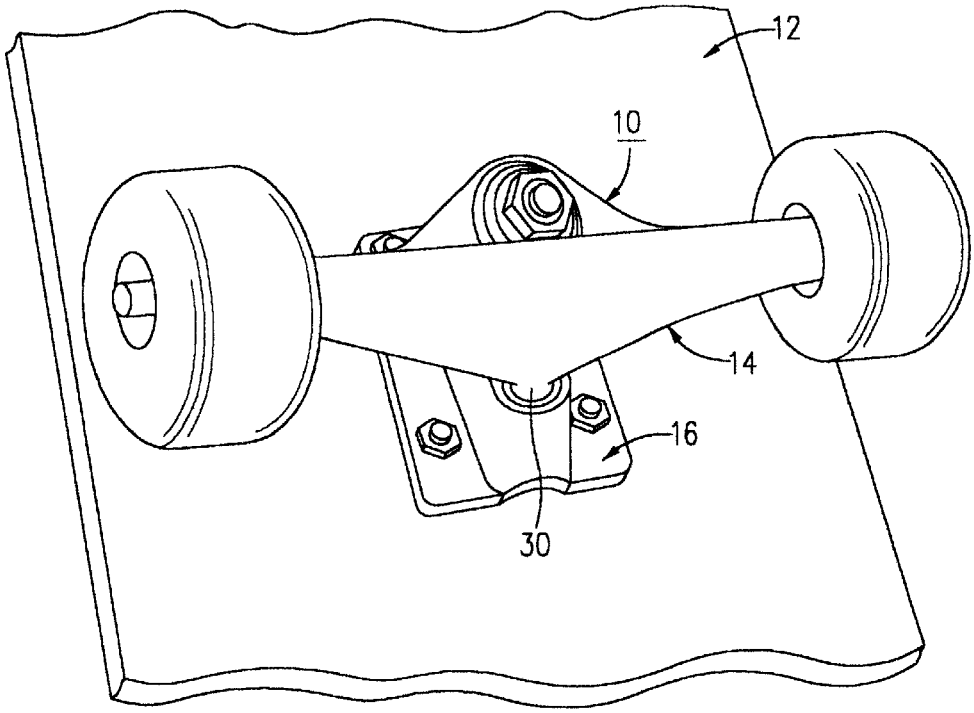
FIG. 1 is a perspective view of a truck having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a truck 10 useful with a skateboard 12 or roller skate. The truck 10 of the invention comprises a truck hanger 14 and a unique mounting bracket 16.

The truck hanger 14 has opposed axle elements 18 for mounting a pair of spaced-apart wheels 20 onto the truck hanger 14. Typically, the wheels 20 comprise an outer wheel portion 22 and an inner precision bearing 24. The wheels 20 are commonly mounted on the axle elements 18 using an axle washer 26 and an axle nut 28. The truck hanger 14 further comprises a hanger pivot pin 30 and a hanger flange 32.

The mounting bracket 16 comprises a base plate 34, a pivot bore 36 and a king pin 38. Typically, the base plate 34 further comprises a plurality of apertures to facilitate the attachment of the base plate 34 to the underside of a skateboard 12 or roller skate, such as by use of nuts 40 and bolts 42.

The pivot bore 36 is dimensioned to accept the hanger pivot pin 30 such that the hanger pivot pin 30 can rotate within the pivot bore 36. Typically, the pivot bore 36 comprises a pivot bushing 44 to facilitate the rotation of the pivot pin 30 within the pivot bore 36.

In the embodiment illustrated in the drawings, the king pin 38 protrudes downwardly from a raised portion of the base plate 34 termed a cushion rest 46. The king pin 38 is typically tilted slightly in the direction of the pivot bore 36. The king pin 38 is dimensioned to be retained within the hanger flange 32 such that the hanger flange 32 can rotate about the king pin 38. In the embodiment illustrated in the drawings, the distal end 47 of the king pin 38 is threaded to accept a king pin nut 49.

Figure 3:
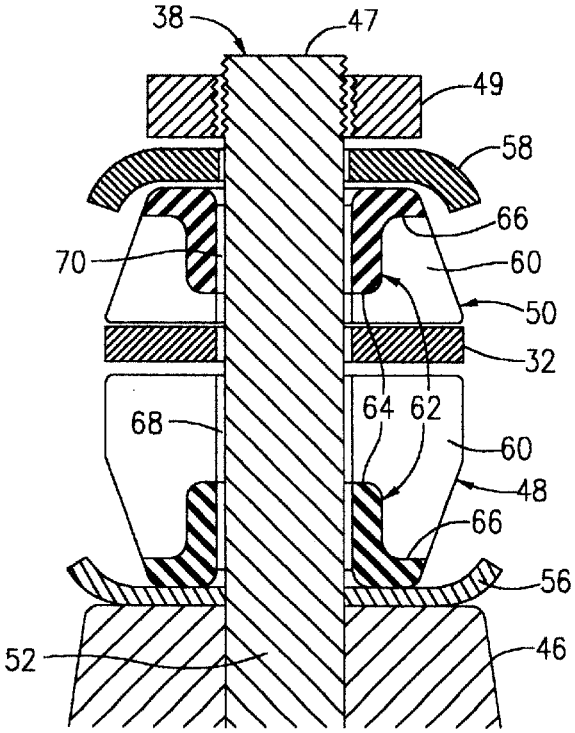
FIG. 3 is a detail view, in cross-section, of the king pin assembly used in the embodiment illustrated in FIG. 1.

The hanger flange 32 is disposed around the king pin 38 sandwiched between an inner cushion member 48 and an outer cushion member 50. The inner cushion member 48 is disposed at the proximal end 52 of the king pin 38 and the outer cushion member 50 is disposed at the distal end 47 of the king pin 38. In a typical embodiment, the inner cushion member 48 is separated from the cushion rest 46 portion by an inner cup washer 56 as illustrated in FIG. 3. Similarly, the outer cushion element 50 is separated from the king pin nut 49 by an outer cup washer 58.

Both the inner cushion element 48 and the outer cushion element 50 comprise an elastomeric outer portion 60 and a substantially rigid liner portion 62 bonded to the outer portion 60. The elastomeric outer portion 60 is typically made from a thermoset polyurethane or rubber. Elastomeric outer portions 60 made from polyurethane having a Shore A hardness of between 70 and 99 have been found particularly suitable in the invention.

The liner portions 62 comprise a tubular moiety 64 and a flange moiety 66. The tubular moieties 64 are disposed within the cushion elements 48 and 50 so as to be in contact with the king pin 38 after assembly. The flange moieties 66 are disposed to be in contact with a corresponding cup washer 56 or 58 when assembled.

The liner portion 62 can be manufactured from almost any substantially rigid material that can be rendered bondable (or is inherently bondable) to the elastomeric outer portion 60. Metals such as aluminum, stainless steel and brass can be used, as can be substantially rigid plastic materials such as hard polyurethanes and fiberglass-reinforced thermoplastic urethanes. Liner portions 62 made from polyurethanes have been found to be suitable in the invention. In one preferred embodiment, the liner portion 62 is injection molded from a 75 Shore D thermoplastic polyurethane filled with fiberglass to make it substantially rigid. The material can be modified by standard means known in the art to increase "bondability" with the elastomeric outer portion 60. In another embodiment, the liner portions are machined from aluminum and then rendered "bondable" with a commercial coating sold under the trademark "ChemLok®," marketed by Lord Corporation of Erie, Pa.

After the liner portion 62 is completed, the elastomeric outer portion 60 is cast around the liner portion 62 in an open mold, typically a steel, urethane or aluminum mold. Elastomers used in the manufacture of the outer portions can be varied to produce outer portions 60 having suitable hardness, resiliency and other mechanical properties. In a typical embodiment, the hardness of the outer portion 60 is between about 70 Shore A and about 99 Shore A. High rebound castable polyurethane suitable in the manufacture of the outer portions can be obtained from UniRoyal Chemical Company of Middleburry, Conn. Specific pre-polymers for use in the manufacture may be UniRoyal prepolymers B-625 and B-821, cured with 1, 4 butanediol and PTMEG-1000. The chemicals are mixed in various concentrations to achieve desired hardness, resiliency and other mechanical properties. Various additives known in the art can be added to achieve desired mechanical properties.

In a typical manufacturing process, the cushion members are manufactured in a process comprising the following steps:

(1) The liner portions 62 are injected-molded and kept clean to avoid oily contamination which might inhibit proper bonding;

(2) The liners are then preheated to about 60° C.;

(3) A suitable mold is coated with silicon mold release;

(4) The mold is pre-heated in an oven to a temperature of about 100° C.;

(5) The outer portion prepolymer and curative are preheated to a temperature between about 60° C. and about 75° C.;

(6) The prepolymers and the curatives are mixed in appropriate proportions to create an elastomer of the desired hardness, and the mixture is then de-gassed to eliminate entrapped gas that could cause bubbles within the final product;

(7) The dry, clean, pre-heated liner member 62 is installed within the mold cavity and the elastomer is poured around the liner portion;

(8) The mold is then heated to about 120° C. for about 45 minutes in a pre-cure step;

(9) The liner portion 62 and elastomeric outer portion 60 (now bonded together) are removed from the mold and allowed to cure at room temperature for 24–48 hours;

(10) The open end of the cushion member 48 or 50 is then trimmed in a lathe to a desired length; and (11) The cushion member 48 or 50 is allowed to cure for an additional seven days.

In a typical embodiment, the inner cushion member 48 has an overall height of 0.5–0.6 inches and an outside diameter of 0.75–1.25 inches. A central bore 68 for receiving the king pin 38 is disposed through the center of the inner cushion member 48, the central bore 68 having a diameter slightly larger than that of the king pin 38. In such a typical embodiment, the outer cushion member 50 has an overall height of 0.35–0.60 inches and outside diameter of 0.75–1.25 inches. Like the inner cushion member 48, the outer cushion member 50 has a central bore 70 for receiving the king pin 38, the central bore 70 having a diameter slightly larger than that of the king pin.

In the typical embodiments discussed in the previous paragraph, both the inner cushion member 48 and the outer cushion member 50 have liner portions 62 which comprise a tubular moiety 64 and a flange moiety 66. The tubular moiety 64 has an overall height of 8–12 mm and an inside diameter of 8–12 mm. The flange moiety 66 of each liner portion is typically 4–6 mm in width. Both the tubular moiety 64 and the flange moiety 66 are 2–3 mm in thickness.

Because the cushion elements in the truck are provided with rigid liner portions that are bonded to the resilient outer portions, the cushion elements have increased rigidity and stability. Moreover, the cushion elements impart to the truck quicker and smoother handling. Cushion members do not "mush out" as do cushion members of the prior art, nor do they become dislodged or damaged within the truck as often happens to prior art cushion members.

Figure 4:
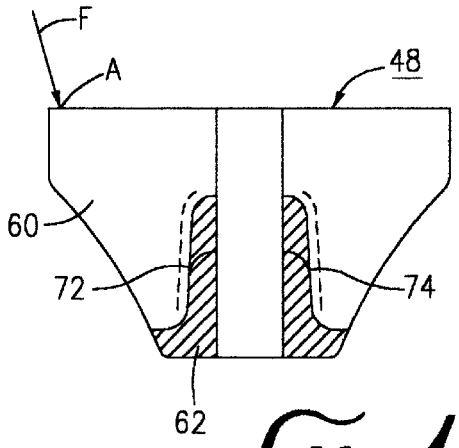
FIG. 4 is a detail view, in cross-section, of a cushion element useful in the invention.
Figure 2:
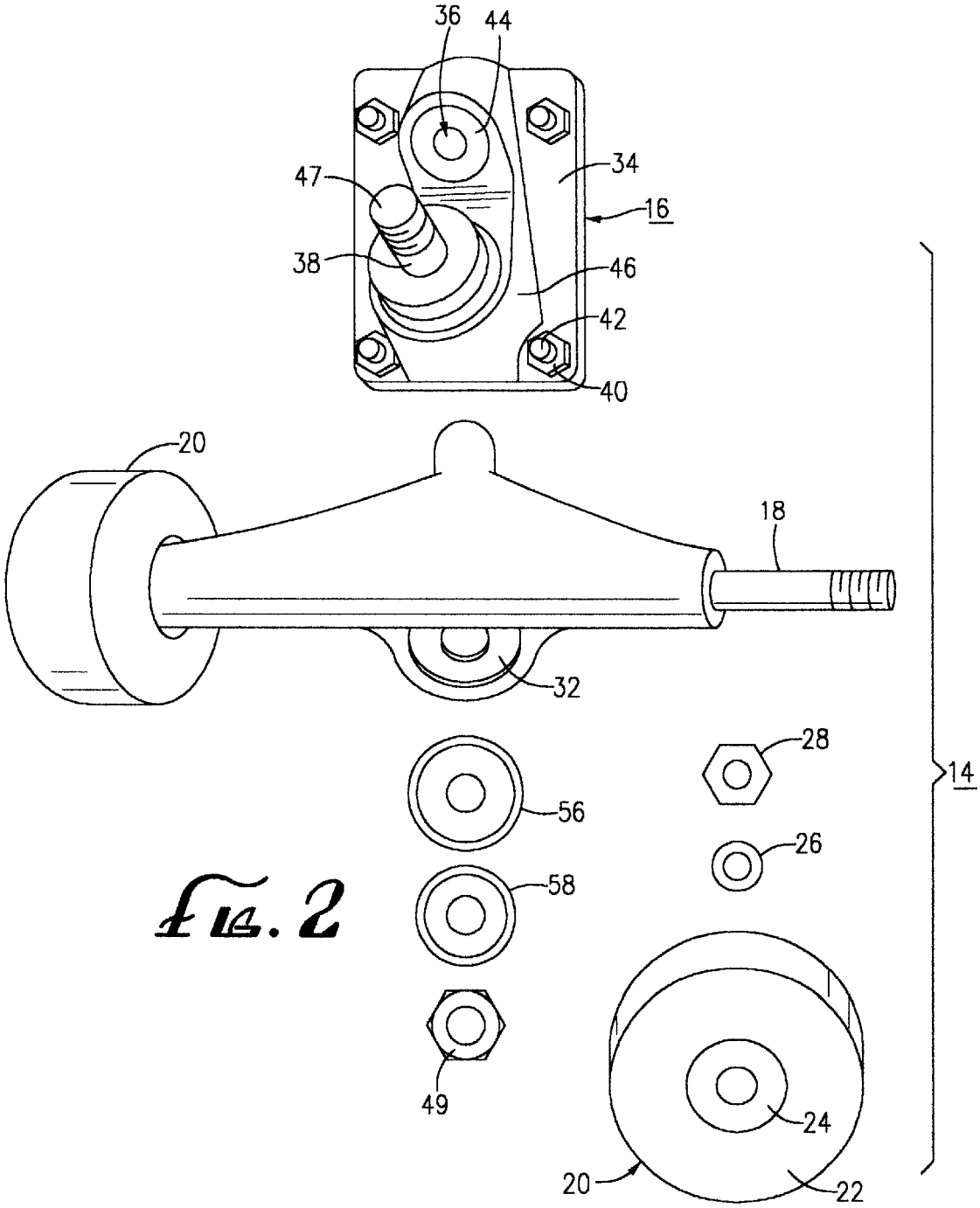
FIG. 2 is an exploded view of the truck illustrated in FIG. 1.

Moreover, with trucks of the invention, the compressing of one side of the cushion member results in an opposite side resistance arising from the use of the bonded rigid liner portion. The compressive force applied by the truck in one direction is transmitted down around the cushion to the opposite side where the compressive force is counteracted by a resistance force applied via the liner member to the outer member. This is illustrated in FIG. 4 wherein a force F is applied to a cushion member at point A. This application of the force F places the bonded interface portion of the outer cushion member nearest to point A (indicated by element 72 in FIG. 4) in shear, as well as in compression. Conversely, the application of the force F places the bonded interface of the outer cushion member 50 furthest away from point A (indicated by element 74 in FIG. 4) into both shear and tension. Thus, the cushion members of the invention are in effect "double action" cushion members, as opposed to cushion members of the prior art which are merely "single action" cushion members. Also, the "axial" component of the turning force is resisted by both the compression of the cushion and also by the shear component added by bonding the cushion to the cylindrical part of the liner.

With the truck 10 of the invention, the force required to turn the truck can be modified for different applications by adjusting the hardness of the outer and inner cushion members 50 and/or by adjusting the pre-tension force applied to the inner and outer cushion members 48 and 50 (using, for example, the king pin nut 49).

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A truck suitable for use on a skateboard or roller skate, the truck comprising:

(a) a truck hanger having opposed axle elements, a wheel mounted on each axle element, a hanger flange and a hanger pivot; and (b) a mounting bracket for attachment of the truck hanger to a skateboard or roller skate, the mounting bracket comprising a base plate, a pivot bore and a king pin protruding downwardly from the mounting bracket, the king pin having a proximal end and a distal end, the mounting bracket further comprising an inner cushion element and an outer cushion element, both the inner cushion element and the outer cushion element having a central bore, a proximal end of the inner cushion element being disposed around the proximal end of the king pin and the outer cushion element being disposed around the distal end of the king pin;

wherein the truck hanger is affixed to the mounting bracket with the hanger pivot disposed within the pivot bore and with the hanger flange disposed over the king pin between the inner cushion element and the outer cushion element; and wherein both the inner cushion element and the outer cushion element comprise an elastomeric outer portion and a substantially rigid liner portion bonded to the outer portion, the liner portion being disposed at the innermost region of each cushion element so as to define at least a portion of the central bore of each cushion element.

2. The truck of claim 1 wherein the liner portion of the cushion elements has a tubular moiety and a flange moiety.

3. The truck of claim 2 wherein the average thickness of the tubular moiety is between about 0.050" and about 0.125".

4. The truck of claim 2 wherein the thickness of the flange moiety is between about 0.050" and about 0.125".

5. The truck of claim 1 wherein the liner portion comprises a metal selected from the group of metals consisting of aluminum, stainless steel and carbon steel brass.

6. The truck of claim 1 wherein the liner portion is made from aluminum.

7. The truck of claim 1 wherein the liner portion comprises a plastic material selected from the group of plastic materials consisting of thermoset, cast polyurethane and thermoplastic polyurethane.

8. The truck of claim 1 wherein the liner portion is made from fiberglass reinforced thermoplastic urethane.

9. The truck of claim 1 wherein the elastomeric outer portion of the cushion elements has a Shore A hardness between about 70 and about 99.

10. The truck of claim 1 wherein the inner cushion element is sandwiched between the hanger flange and an inner cup washer and wherein the outer cushion element is sandwiched between the hanger flange and an outer cup washer.

11. The truck of claim 1 in combination with a skate attached to the mounting bracket.

12. The truck of claim 11 wherein the skate is a skate board.

13. A truck suitable for use on a skateboard or roller skate, the truck comprising:

(a) a truck hanger having opposed axle elements, a wheel mounted on each axle element, a hanger flange and a hanger pivot; and (b) a mounting bracket for attachment of the truck hanger to a skateboard or roller skate, the mounted bracket comprising a base plate, a pivot bore and a king pin protruding downwardly from the mounting bracket, the king pin having a proximal end and a distal end, the mounting bracket further comprising an inner cushion element and an outer cushion element, both the inner cushion element and the outer cushion element having a central bore, a proximal end of the inner cushion element being disposed around the proximal end of the king pin and the outer cushion element being disposed around the distal end of the king pin, both cushion elements have a Shore A hardness between about 70 and about 99;

wherein the truck hanger is affixed to the mounting bracket with the hanger pivot disposed within the pivot bore and with the hanger flange disposed over the king pin between the inner cushion element and the outer cushion element; and wherein both the inner cushion element and the outer cushion element comprise an elastomeric outer portion and a substantially rigid liner portion bonded to the outer portion, the liner portion having a tubular moiety and a flange moiety, the liner portion being disposed at the innermost region of each cushion element so as to define at least a portion of the central bore of each cushion element.

14. The truck of claim 13 wherein the average thickness of the tubular moiety is between about 0.050" and about 0.125".

15. The truck of claim 13 wherein the thickness of the flange moiety is between about 0.050" and about 0.125".

16. The truck of claim 13 wherein the liner portion comprises a plastic material selected from the group of plastic materials consisting of thermoplastic polyurethane and thermoset polyurethane.

17. The truck of claim 13 wherein the liner portion is made from fiberglass reinforced thermoplastic urethane.

18. The truck of claim 13 wherein the elastomeric outer portion of the cushion elements has a Shore A hardness between about 70 and about 99.

19. The truck of claim 13 wherein the inner cushion element is sandwiched between the hanger flange and an inner cup washer and wherein the outer cushion element is sandwiched between the hanger flange and an outer cup washer.

20. The truck of claim 13 in combination with a skate attached to the mounting bracket.

* * * * *